US012139923B2

(12) United States Patent
Fitzgibbins

(10) Patent No.: US 12,139,923 B2
(45) Date of Patent: Nov. 12, 2024

(54) TENT

(71) Applicant: Oztent Australia Pty. Limited, Wetherill Park (AU)

(72) Inventor: Trent Fitzgibbins, Wetherill Park (AU)

(73) Assignee: Oztent Australia Pty. Limited, Wetherill Park (AU)

( * ) Notice: Subject to any disclaimer, the term of this patent is extended or adjusted under 35 U.S.C. 154(b) by 133 days.

(21) Appl. No.: 17/782,192

(22) PCT Filed: Nov. 27, 2020

(86) PCT No.: PCT/AU2020/051293
§ 371 (c)(1),
(2) Date: Jun. 3, 2022

(87) PCT Pub. No.: WO2021/108841
PCT Pub. Date: Jun. 10, 2021

(65) Prior Publication Data

US 2023/0009345 A1 Jan. 12, 2023

(30) Foreign Application Priority Data

Dec. 4, 2019 (AU) ..... 2019904590

(51) Int. Cl.
*E04H 15/38* (2006.01)
*E04H 15/48* (2006.01)

(52) U.S. Cl.
CPC ..... *E04H 15/38* (2013.01); *E04H 15/48* (2013.01)

(58) Field of Classification Search
CPC ..... E04H 15/38; E04H 15/48
See application file for complete search history.

(56) References Cited

U.S. PATENT DOCUMENTS

| | | | | |
|---|---|---|---|---|
| 137,579 | A * | 4/1873 | Turner | E04H 15/38 135/132 |
| 3,513,861 | A * | 5/1970 | Johnson | E04H 15/38 135/132 |
| 4,612,948 | A * | 9/1986 | Simpson | E04H 15/001 135/900 |
| 4,748,995 | A | 6/1988 | Viglione | |
| 6,209,558 | B1 * | 4/2001 | Viglione | E04H 15/48 135/132 |
| 8,408,225 | B2 | 4/2013 | Mallookis et al. | |
| 9,506,269 | B2 * | 11/2016 | Armstrong | E04H 15/06 |
| 11,208,827 | B2 * | 12/2021 | Long | E04H 15/38 |

(Continued)

FOREIGN PATENT DOCUMENTS

| | | |
|---|---|---|
| AU | 2015202086 A1 | 11/2015 |
| WO | WO 2012/065226 A1 | 5/2012 |
| WO | WO 2018/232440 | 12/2018 |

OTHER PUBLICATIONS

PCT Search Report, Dec. 22, 2020.

*Primary Examiner* — Noah Chandler Hawk
(74) *Attorney, Agent, or Firm* — Dority & Manning, P.A.

(57) ABSTRACT

A frame 1 for mounting a portable enclosure 2 to form a tent. The frame 1 includes a first sub-frame 4, a second sub-frame 5 and a third sub-frame 6. Each sub-frame 4, 5, 6 has a pair of side members 7 connected by at least one cross member 8. The side members 7 of the sub-frames 4, 5, 6 taper inwardly from the captured ends 10, 11 to said cross members 8 to form a generally trapezium shape.

10 Claims, 6 Drawing Sheets

(56) References Cited

U.S. PATENT DOCUMENTS

| | | | | |
|---|---|---|---|---|
| 2011/0146737 | A1* | 6/2011 | Friedman | E04H 15/06 135/88.13 |
| 2015/0308146 | A1* | 10/2015 | Mercieca | E04H 15/48 135/147 |
| 2016/0143451 | A1* | 5/2016 | Le | A47C 17/70 135/126 |

* cited by examiner

TENT

FIELD OF THE INVENTION

The present invention relates to a tent and, in particular to, a tent where the frame tapers from a wider front to a narrower rear to provide a large front area while still folding into a small volume.

BACKGROUND OF THE INVENTION

Enclosures are used throughout the world to protect people and goods from the elements, animals or other people. Most enclosures are fixed structures such as buildings, sheds, or the like. There is however a need for portable enclosures for temporary use. For example, portable enclosures are commonly used during music, sporting and other social events. Portable enclosures have also been used in places such as sporting fields and beaches to inhibit sun exposure or as pop-up testing or dispensing facilities. Portable enclosures are also commonly used in the form of tents or the like during camping, hiking or on expeditions.

A major disadvantage with existing portable enclosures, like a tent, is that any larger sized enclosure requires a significant number of parts, elements and time to erect. This is typically due to the frame structure used. Though smaller enclosures exist, such as swags or the like, those smaller enclosures are not sufficient in size for most uses or for multiple people. Further, most frames are limited to fit with only a simple cover, limiting their use.

There is a need for a good portion of the living area to be taut, offering a superior profile for weather protection and airflow. There is also a need for a frame and tent that offers an extended section at the back, front and/or sides providing additional versatility.

Accordingly, there is a need for a tent that can provide added living space in a quick, easy way and where the frame is compact in travel.

OBJECT OF INVENTION

It is an object of the present invention to substantially overcome or at least ameliorate one or more of the disadvantages of the prior art, or to at least provide a useful alternative.

SUMMARY OF INVENTION

There is disclosed herein a self-supporting frame for mounting an enclosure; the frame having:

- a first sub-frame, a second sub-frame and a third sub-frame;
- each said sub-frame having a pair of elongate side members having a first captured end and a second free end;
- each said second free end being connected by and spaced apart by an elongate cross member;
- each side member is connected to the cross member by a corner fitting angled at greater than 90 degrees;
- a base hinge (foot) pivotally retaining said first captured ends of said sub-frames and adapted to permit movement of said sub-frames with respect to each other;
- the base hinge (foot) has an angled base (boot) that allows the base hinge (foot) to sit flat on the ground when the frame is erected;
- a pair of support/bracing members extending from the elongate side members of the top and bottom most sub-frames, connecting to the side members of the middle sub-frame;

- the support/bracing members connect to the middle sub-frame by a slider that allows the supporting/bracing members to move up and down the side members of the middle sub-frame when the frame is being erected or folded down;
- the elongate cross members including hinges to permit folding with respect to each other when the frame is collapsed; and
- wherein said side members of said sub-frames taper inwardly from said captured ends to said cross members to form a generally trapezium-shaped cross section.

Preferably, the elongate side members may be telescopically extendable elongate side members.

Preferably, the elongated cross members may be telescopically extendable elongate cross members.

Preferably, the Support/Bracing members may be telescopically extendable supporting/bracing members.

Preferably, the elongate side members are operatively associated with each other so that in a closed configuration each are substantially parallel to each other and in an opened configuration each are substantially spaced apart radially from each other.

Preferably, the elongate cross members are adapted to fold into a first portion and a second portion so that each portion is substantially parallel to each other when the frame is in the closed configuration.

Preferably, said tent includes an awning extendable from adjacent one said cross member.

Preferably, said awning has a trapezium-shaped cross section.

Preferably, at a base, the front of the tent is wider than the rear of the tent.

BRIEF DESCRIPTION OF DRAWINGS

A preferred embodiment of the invention will now be described, by way of example only, with reference to the accompanying drawings, wherein.

DESCRIPTION OF EMBODIMENTS

Figure 1:
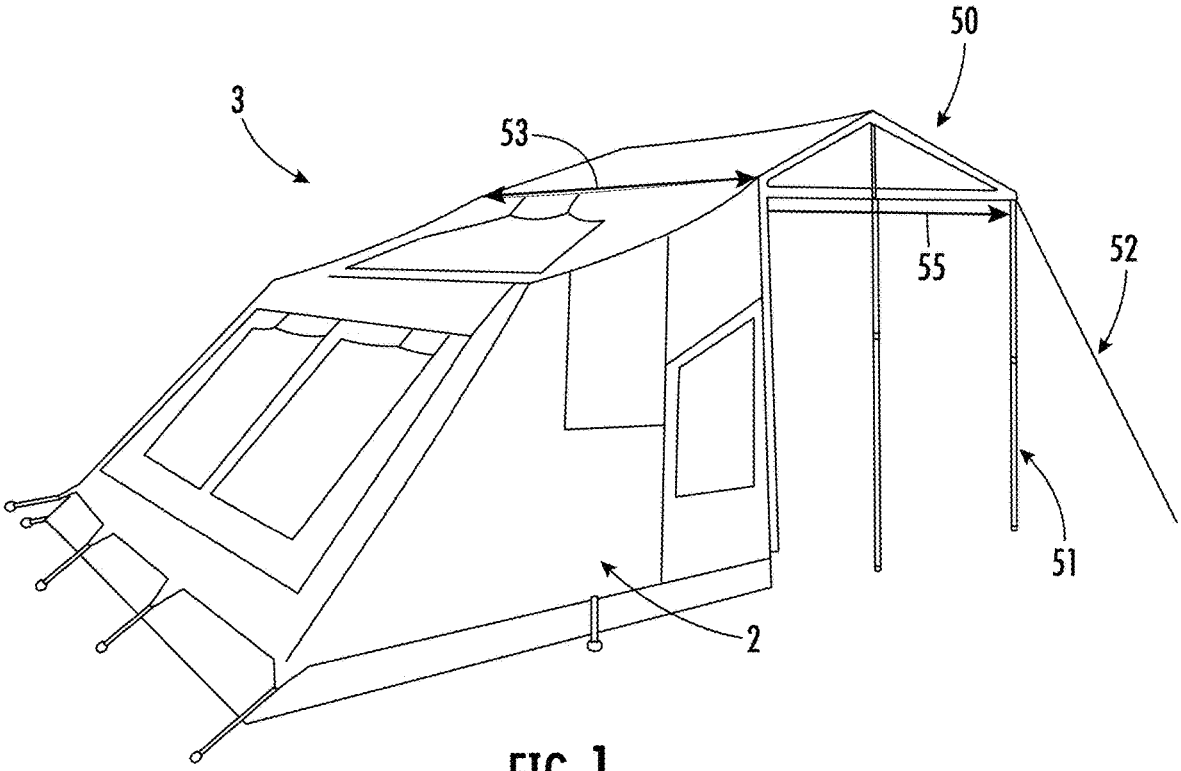
FIG. 1 shows a tent of an embodiment of the present invention in the pitched (erected) configuration.
Figure 2:
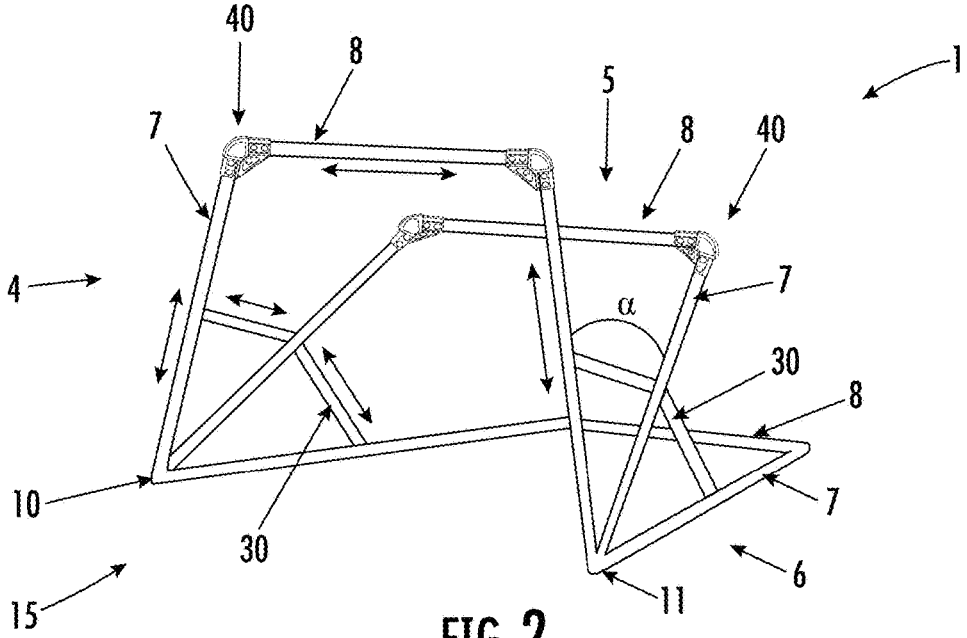
FIG. 2 shows the frame of FIG. 1.

There is disclosed herein a frame 1 for mounting a portable enclosure 2 to form a tent 3 or the like. In a preferred form, the frame 1 (see FIG. 2) would be internal of the enclosure 2 as best seen in FIG. 1, however it could also be external or a combination of internal and external. The enclosure 2 could be made of a polycotton and include a fiber reinforced PVC floor (not shown). It should however be understood that other enclosures could be utilized. The frame 1 includes a first sub-frame 4, a second sub-frame 5 and a third sub-frame 6 however the frame 1 could include any number of sub-frames 4, 5, 6. Each sub-frame 4, 5, 6 has a pair of side members 7 connected by at least one cross member 8. In the preferred form, the frame 1 has no cross member located between the sub-frames 4, 5, 6 at the surface level (captured ends) in the front of the tent 3 and shown at "A" in FIG. 2. The side members 7 of the sub-frames 4, 5, 6 taper inwardly from the captured ends 10, 11 to said cross members 8 to form a generally trapezium shape. That is, the front of the tent 3 is wider at the base (ground surface and location A) than the rear or top of the tent 3. It could be, for example, 307 cm at the front and 210 cm at the rear. This provides a significantly large front area of available living space.

Figure 3:
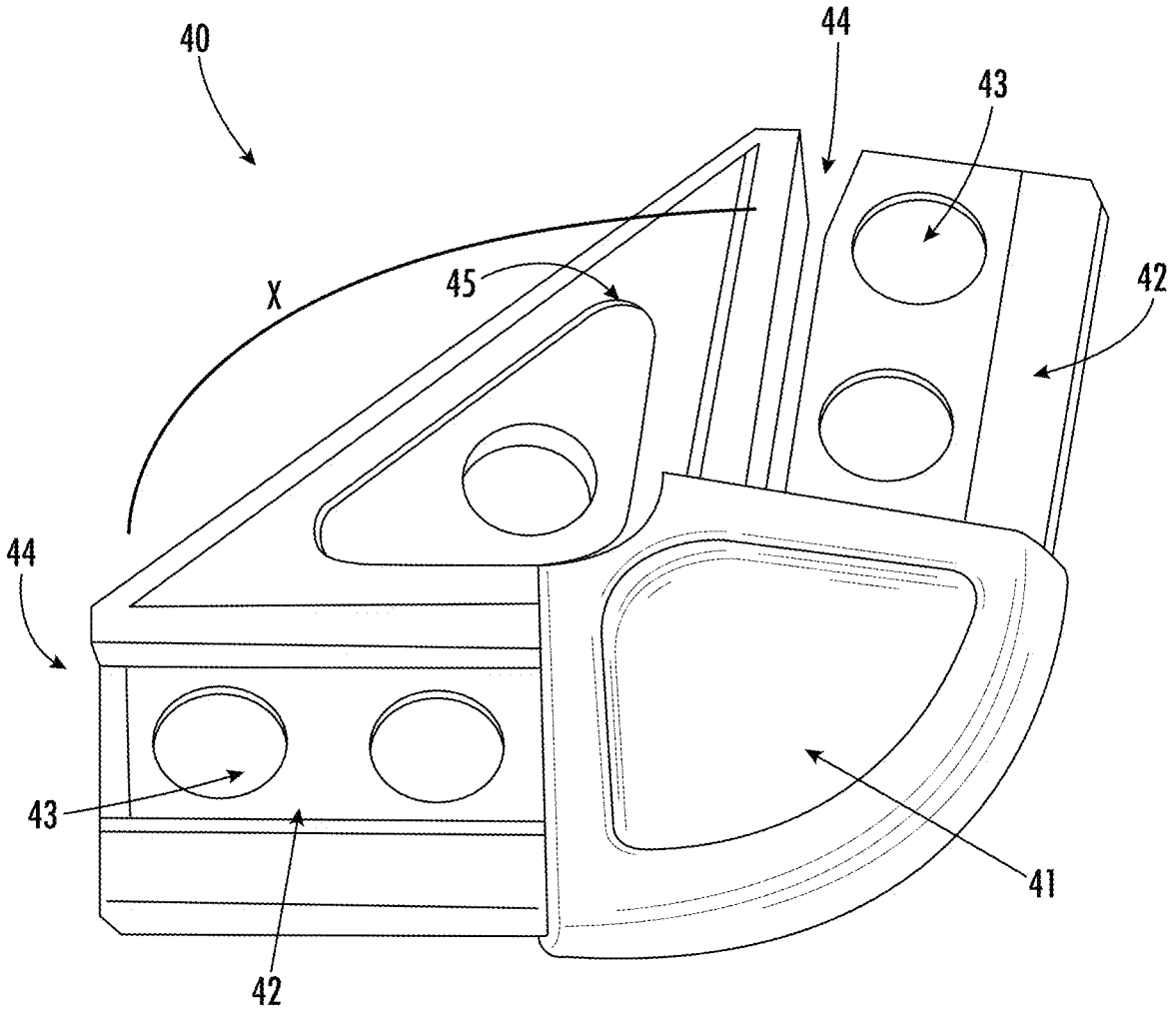
FIG. 3 shows a corner fittings used in an embodiment of the frame of FIG. 2.

In a preferred embodiment, the side members 7 are preferably telescopically extendable (indicated by the double-arrow lines in FIG. 2) so that their longitudinal length can be varied by a user. A locking means (not shown) could be utilized to lock the telescopically extending side members 7 at a particular length. The supporting/bracing members 30 could also be telescopically extendable (indicated by the double-arrow lines in FIG. 2). The cross members 8 could also be telescopically extendable (indicated by the double-arrow lines in FIG. 2). The cross members 8 and side members 7 in the preferred form are connected together by a corner fitting 40 as best seen in FIG. 3. The corner fitting 40 having a body 41 and arms 42 extending away from the body 41 to define an angle X that is greater than 90 degrees. The arms 42 would have connectors 43 and channels 44 to connect to side or cross members 7, 8. A center support 45 could also be included to add stability. Further hinges (not shown) can be included to permit portions of the members 7, 8 to fold with respect to each other to be substantially parallel when the frame 1 is in the closed (collapsed or folded) configuration. The hinges could be located at any distance along the members 7, 8. For example, a hinge could be located 30 cm away from each corner towards the middle of a cross member 8. The side and cross members 7, 8 can include slide mechanisms, twist and lock mechanisms, snap locks, press button locks or the like (not shown). The hinges located near the corners permit the side members 7 and cross members 8 to form a right angle in the open (erect) configuration and in the closed (collapsed) configuration to be substantially parallel to each other.

As best seen in FIGS. 4*a* to 4*f*, a base hinge/foot 15 is located at the captured ends 10,
11 of each of the side members 7 of the sub-frames 4, 5 and 6. The base hinge/foot 15 permits the side members 7 to pivot about the base hinge 15 and move apart from each other so that in the closed (collapsed) configuration each of the side members 7 are located substantially parallel to each other and in the opened (erect) configuration each of the side members 7 are radially spaced apart, as shown in the drawings by an acute angle a. They could however be spaced apart by any suitable angle. The preferred angle is 45° in the instance of three sub-frames 4, 5, 6 as shown in the drawings.

Figure 4A:
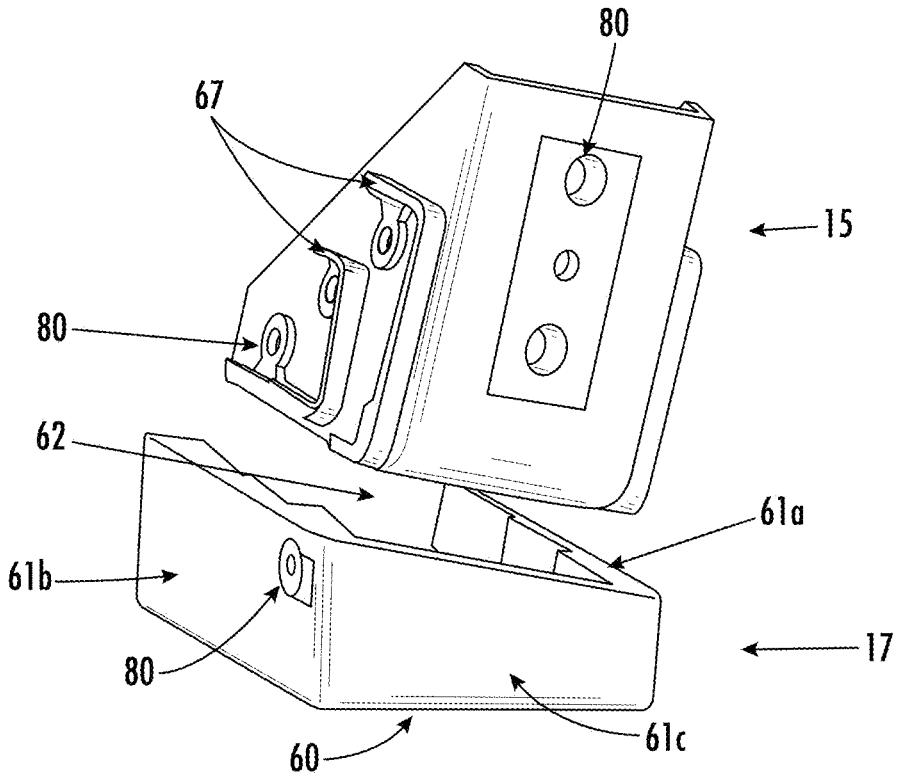
FIGS. 4*a* to 4*f* show angled base hinge/foot and boot parts used in an embodiment of the frame of FIG. 2.
Figure 4B:
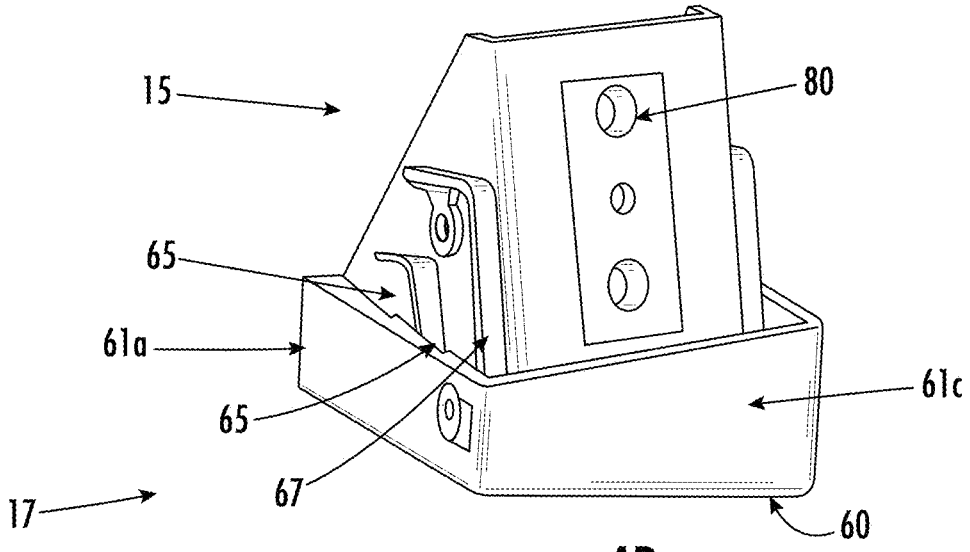
Figure 4C:
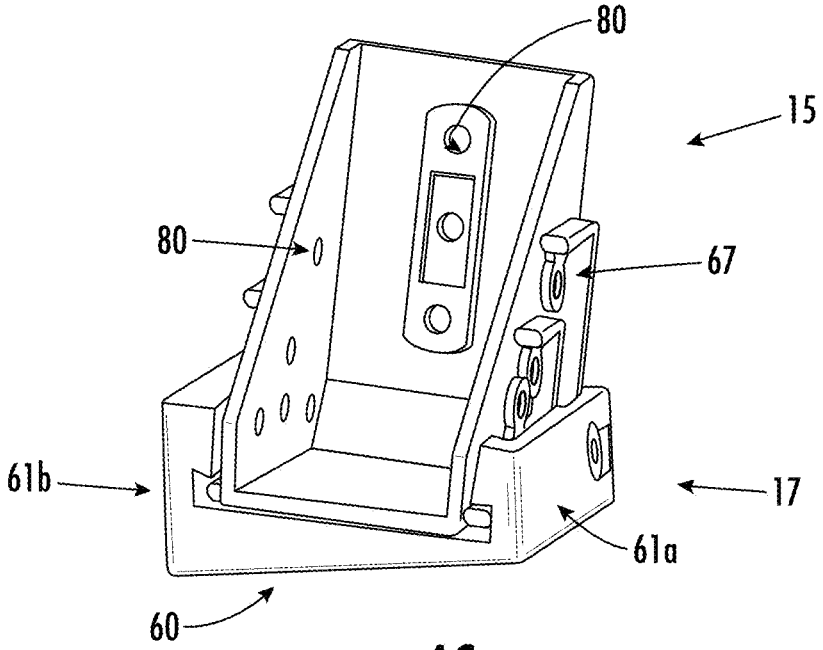
Figure 4D:
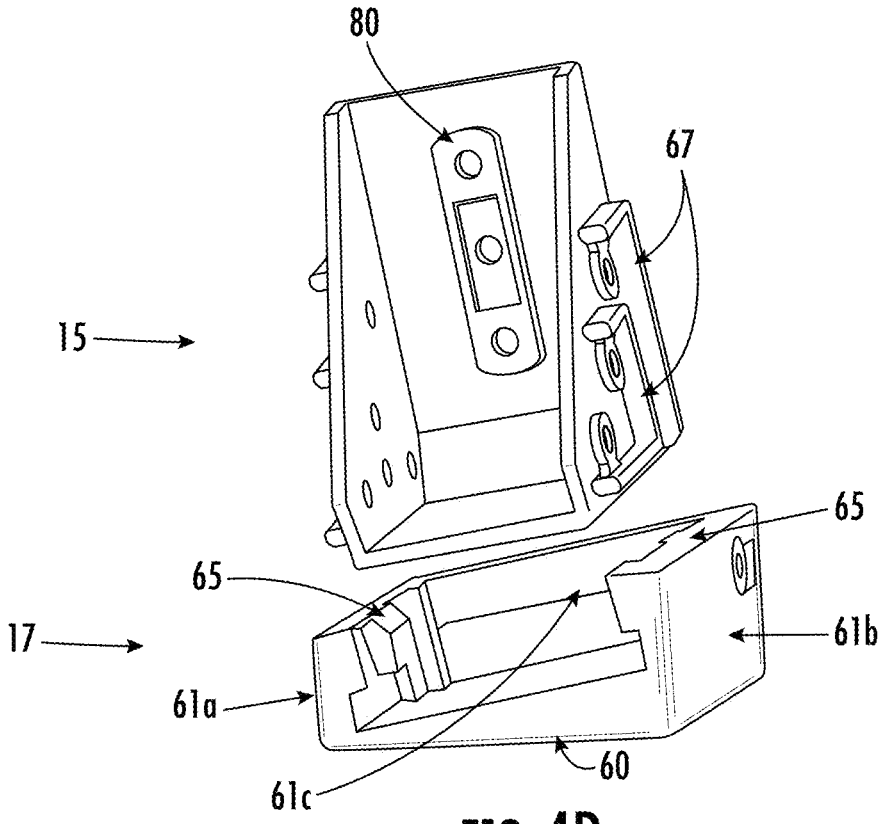
Figure 4E:
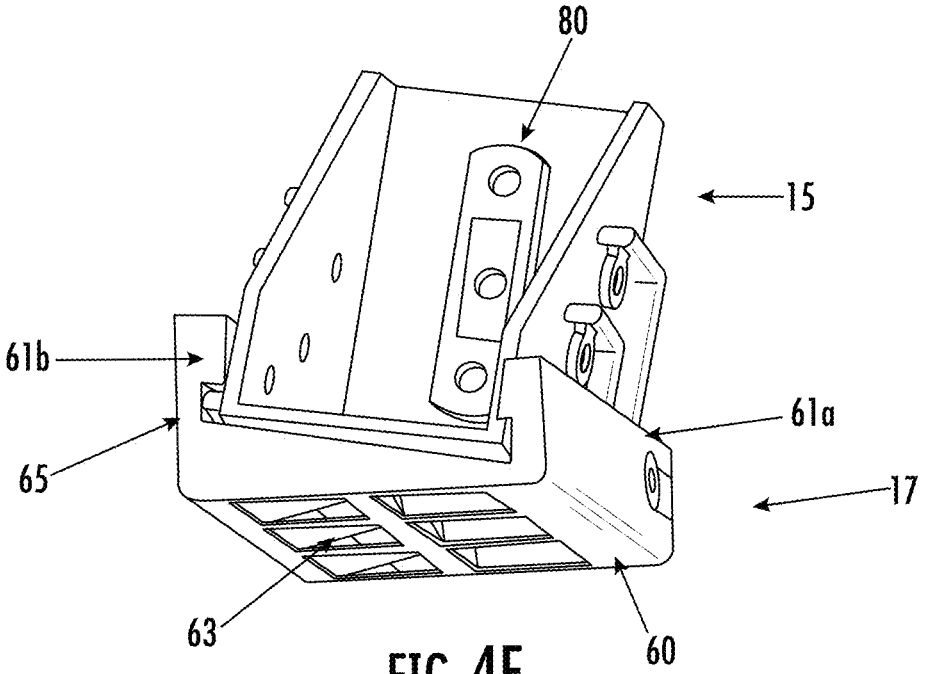
Figure 4F:
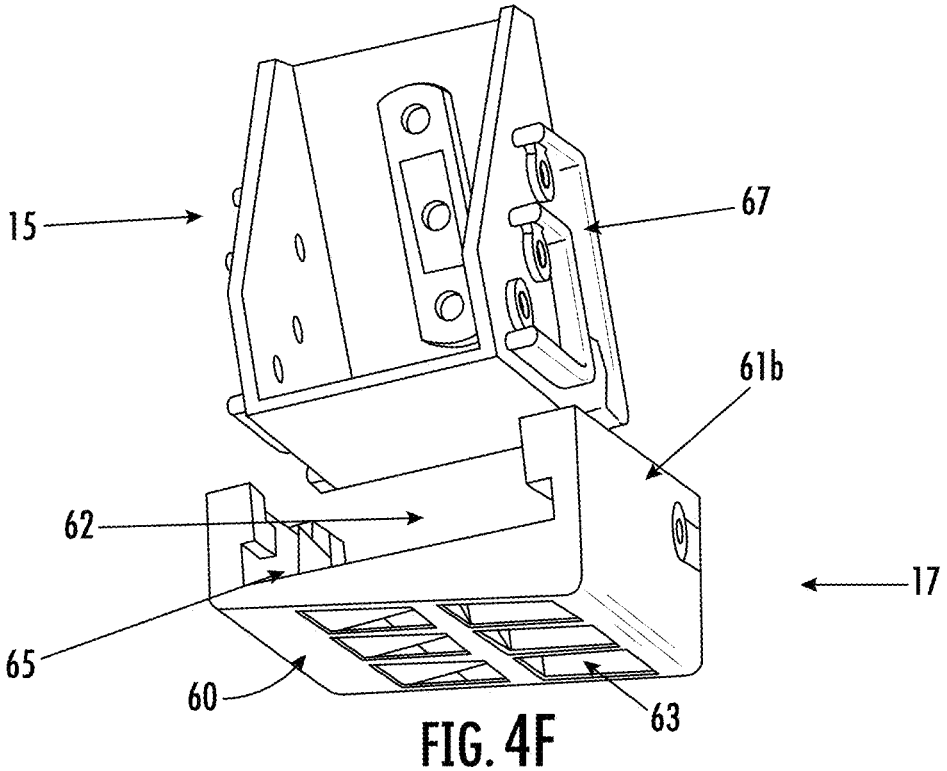

The base hinge/foot 15 is angled in a way to accommodate the trapezium shape of the frame 1 when erected. The base hinge/foot 15 achieves this angle by sitting in an associated angled boot 17. The separate boots 17 for each captured end 10 and 11 create an equal but opposing angle of the side members 7. The boot 17 includes a flat base 60 to be supported in use on a surface. The base 60 could include cut outs 63 to reduce weight and/or support contact with a ground surface. Side walls 61*a,b,c* extend upwardly from the flat base 60 to define a space 62 to receive the hinge foot 15. One side wall 61*a* is lower in height from the base 60 than an opposing side wall 61*b* with the connecting side wall 61*c* on an angle as shown in FIG. 4*d*. One or more side walls 61*a,b,c* include male and/or female slots/guides 65 on the side-bordering the space 62 to receive corresponding male and/or female guides/slots 67 extending from the hinge 15 to slot 65, position and/or lock the hinge foot 15 to the boot 17 as best seen in FIG. 4*b*. The hinge foot 15 and boot 17 can also include a series of holes 80 to permit fastening of the foot 15, boot 17 and/or captured ends 10, 11 and/or side members 7 together.

In a preferred embodiment there is also included support/bracing members 30 to allow the sub-frames 4,5,6 to be locked in place when the frame is erected. The support/bracing members 30 are connected to the side members at appropriate distances to allow the free opening and closing of the frame 1. That is, the members 30 can be folded up or expanded out and locked in various configurations sliding along the side members 7. The frame 1 could further include numerous mounts (not shown) for the securing of pegs, lines or the like to provide further stability. The frame 1 could be any size due to the ability of each of the members to fold with respect to each other or be telescopic.

Figure 5:
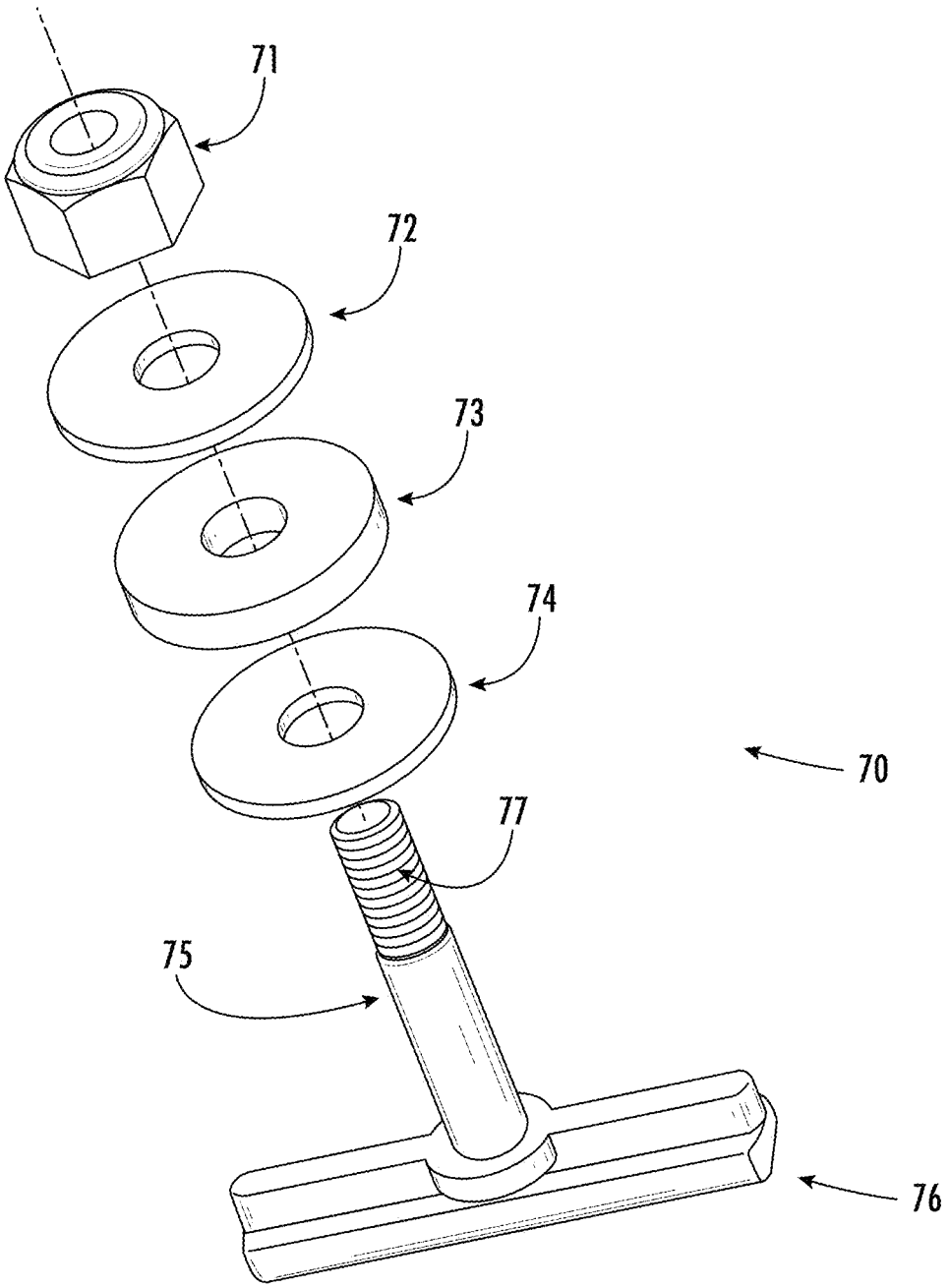
FIG. 5 shows slider mechanism used in an embodiment of the frame of FIG. 2.

In FIG. 5, there is shown a "T" pivot sliding hinge 70 constructed in a way that allows it to move up and down the side members 7 of the middle sub-frame 5 (or the relevant middle sub-frame if more than three sub-frames are utilized). It consists of a locking nut 71, a flat washer 72 and a flexible/compressible washer 73 and optionally another flat washer 74 to be connected to a bolt shaft 75 having a threaded end 77 connected to a slider 76. The flexible/compressible washer 73 allows the pivot sliding hinge slider 76 to move freely without placing excessive load on the support/bracing members 30 when opening and closing the frame 1

As best seen in FIG. 1, the tent 3 further includes one or more annexes or awnings 50 extending from the enclosure 2 and held at an extended position by poles 51 and ropes 52. The awning panels 50 can be stitched, zipped, clipped, buttoned, use magnets or the like to the enclosure 2 and have a trapezium-shaped cross section with a top width 53 that is less than a bottom width 55 so as to match the trapezium shape of the first frame 4 when the awning panel 50 is in a lowered position. Any number of side, front or back annexes could be added. By adding a zip or the like in the end of the awning, a further extension can be folded out taking the length to unlimited distances.

The frame 1 and enclosure 2 can be folded and placed in a carry pack (not shown). The pack could be made of a polyester fabric, polycotton or the like and include two or more handles. Once the pack is opened by way of fasteners such as clips, Velcro™, zippers or the like, the tent is unrolled by a user. Either the right or left arms are opened first. The tent 2 can then be erected by pulling up each set of arms 7. The arms 7 slide as described above and have Velcro™ or the like securing to fasten the sliding arms, the enclosure, extrusions or a combination thereof. Any extra fabric and/or annexures can be pulled out and pegged in the usual manner. In a preferred form, the tent can be erected by pulling up the uppermost sub-frames 4,5. The supporting bracing members 30 slide into place as described above and have Velcro™ or the like securing to fasten the supporting bracing members, the enclosure, extrusions or a combination thereof.

Although the invention has been described with reference to specific examples, it will be appreciated by those skilled in the art that the invention may be embodied in many other forms.

The invention claimed is:

1. A self-supporting frame for mounting an enclosure; the frame having:

a first sub-frame, a second sub-frame and a third sub-frame;

each said sub-frame having a pair of elongate side members having a first captured end and a second free end;

each said second free end being connected by and spaced apart by an elongate cross member;

each side member is connected to the cross member by a corner fitting angled at greater than 90 degrees;

a base foot system at a location of the first captured ends for pivotally retaining said first captured ends of said sub-frames and adapted to permit movement of said sub-frames with respect to each other;

a pair of support members extending from the elongate side members of the top and bottom most sub-frames, connecting to the side members of the middle sub-frame;

the support members connecting to the middle sub-frame by a slider that allows the support members to move up and down the side members of the middle sub-frame when the frame is being erected or collapsed;

wherein said side members of said sub-frames taper inwardly from said captured ends to said cross members to form a generally trapezium-shaped cross section;

the base foot system comprising:

a boot having a flat bottom surface and an internal receipt space oriented at an angle that defines the taper of the side members from the captured ends to the cross members;

a hinge foot, the first captured ends of the elongate side members pivotally received in the hinge foot;

wherein the hinge foot is separate from and insertable into the internal receipt space of the boot to define the trapezium-shaped cross section of the sub-frames.

2. The frame of claim 1, wherein the elongate side members are telescopically extendable elongate side members.

3. The frame of claim 1, wherein the elongate cross members are telescopically extendable elongate cross members.

4. The frame of claim 1, wherein the elongate side members are operatively associated with each other so that in a collapsed configuration each are substantially parallel to each other and in an erected configuration each are substantially spaced apart radially from each other.

5. The frame of claim 1, wherein the elongate cross members are adapted to fold into a first portion and a second portion so that each portion is substantially parallel to each other when the frame is in the collapsed configuration.

6. The frame of claim 1, wherein the enclosure is a tent and the tent includes an awning extendable from adjacent one said cross members.

7. The frame of claim 6, wherein said awning has a trapezium-shaped cross section.

8. The frame of claim 1, wherein the enclosure is a tent and at a base, the front of the tent is wider than the rear of the tent.

9. The frame of claim 1, wherein the support members are telescopically extendable supporting members.

10. The frame of claim 1, wherein the boot comprises an angled internal floor and sidewalls having angled internal surfaces that define the internal receipt space, the hinge foot seated against the angled internal surface and angled internal floor when inserted into the boot.

* * * * *